US007997581B2

(12) United States Patent
Brennan

(10) Patent No.: US 7,997,581 B2
(45) Date of Patent: Aug. 16, 2011

(54) GAMING SYSTEM FOR BINGO-TYPE GAME

(75) Inventor: James William Brennan, Melton (GB)

(73) Assignee: Arrow International, Inc., Cleveland, OH (US)

( * ) Notice: Subject to any disclaimer, the term of this patent is extended or adjusted under 35 U.S.C. 154(b) by 538 days.

(21) Appl. No.: 12/148,054

(22) Filed: Apr. 15, 2008

(65) Prior Publication Data

US 2009/0026703 A1 Jan. 29, 2009

(30) Foreign Application Priority Data

Apr. 18, 2007 (GB) ..... 0707568.2

(51) Int. Cl.
*A63F 3/06* (2006.01)

(52) U.S. Cl. ..... 273/269; 273/139; 283/903; 463/19

(58) Field of Classification Search ..... 273/139, 273/269, 274; 463/19; 283/901, 903
See application file for complete search history.

(56) References Cited

U.S. PATENT DOCUMENTS 5,657,991 A * 8/1997 Camarato ..... 273/269
6,382,629 B1 * 5/2002 Hill ..... 273/303
6,425,823 B1 * 7/2002 Byrne ..... 463/16
6,447,395 B1 * 9/2002 Stevens ..... 463/18
6,616,531 B1 * 9/2003 Mullins ..... 463/19
6,908,382 B2 * 6/2005 Walker et al. ..... 463/17
7,566,271 B2 * 7/2009 Hostetler et al. ..... 463/25
7,614,948 B2 * 11/2009 Saffari et al. ..... 463/19
7,665,732 B2 * 2/2010 Stephens ..... 273/139
7,717,785 B2 * 5/2010 Odom ..... 463/19

* cited by examiner

*Primary Examiner* — William M Pierce
(74) *Attorney, Agent, or Firm* — Fay Sharpe LLP

(57) ABSTRACT

A set of game cards, such as bingo cards (10) which each display an arrangement of game indicia, such as bingo numbers (27) are configured for use in combination with jackpot tickets (12) in a game of chance, such as bingo or keno, in which numbers are drawn at random from a pool. The jackpot tickets provide chances for a winner of a bingo game played with the bingo cards to be eligible for a jackpot award. The jackpot tickets (12) each include a set of jackpot numbers (28) selected from the same pool as the bingo numbers (27). These are compared with the bingo numbers on the winning bingo card to determine whether the winning card is eligible for a jackpot award. The jackpot numbers may be arranged in regions (22, 24, 26) corresponding to different award levels, whereby a jackpot number or combination of jackpot numbers from a level which match one or more of the bingo numbers on the winning bingo card, and optionally which meet one or more additional eligibility rules, qualifies the winning card for the jackpot award.

14 Claims, 4 Drawing Sheets

GAMING SYSTEM FOR BINGO-TYPE GAME

BACKGROUND

The present exemplary embodiment relates to the gaming arts. It finds particular application in conjunction with a bingo-type game, and will be described with particular reference thereto. However, it is to be appreciated that the present exemplary embodiment is also amenable to other games, such as keno, or the like.

Bingo is a popular game of chance in which cards from a set are distributed to players. Each card displays at least one bingo face, which consists of a matrix of numbers. In the US, the bingo face is typically a 5×5 matrix, with each column of numbers listed under a letter of the word "bingo." Numbers are announced or "called" from a fixed pool of numbers that are used in the game, e.g., the numbers 1-75, labeled B1-B15, I16-I30, N31-N45, G46-G60 and O61-O75. Each bingo face includes a subset of these numbers. For example, under the letter "B," five unique numbers selected from a subset of the numbers, 1 through 15 may be listed, and so forth. In Europe, bingo cards may have a larger matrix, with more or less than five columns, each column representing numbers in the units, tens, twenties, etc. Matrices of this type include spaces as well as numbers.

There are many different types of bingo games. In one type of game, all of the numbers are drawn for the game before any players view the arrangement of numbers on their bingo cards. The award is a predetermined amount. After the draw occurs, the players may purchase cards and compare the arrangements on the cards to the drawn numbers to determine whether one or more game-winning or other predetermined patterns are matched.

In live bingo games, the game is typically played by marking or filling in a bingo face as corresponding numbers are called from the pool. The numbers are called in a generally random or pseudo-random fashion. In some games, each of those numbers is represented by a ball in a large rotating bin. Each ball has a unique one of the bingo numbers. The bin is rotated and one of the balls is randomly selected. The number of the selected ball is announced (and sometimes displayed) to the players. The players check each of their bingo cards to see if the announced number appears on the card. If the number appears on a card, the player marks (or daubs) the card, using an item such as a bingo marker. When a player achieves a designated winning combination or pattern such as five marked spots in a row, in a column or diagonally, or in other designated combinations, such as "full house" (also known as "cover-all") in which all of the numbers in the bingo face are marked, the player wins the game if that player is the first person to achieve and announce such combination. This is often done by the person calling out "Bingo."

The award for a typical Bingo game is relatively small and depends on the number of players and the organizer's profit margin. To add excitement to the game, it would be advantageous for players to have the chance of winning a larger award, with the costs of that award

BRIEF DESCRIPTION

In accordance with one aspect of the exemplary embodiment, a system for playing a game of chance includes a set of game cards, each of the game cards in the set displaying a game face which includes a set of indicia selected from a pool of indicia. A plurality of jackpot tickets is provided for use in combination with the set of game cards. The jackpot tickets each display at least one jackpot indicium selected from the pool of indicia, whereby a player who wins a game of chance played with the game face is able to identify whether he is also a winner of a jackpot award.

In another aspect, a method for playing a game of chance includes distributing game cards from a set of game cards to a plurality of players, each of the game cards in the set displaying at least one game face which includes a set of game indicia selected from a pool of indicia. The method further includes associating at least one jackpot indicia with each game card in the set of game cards. A game of chance is played in which the players match indicia randomly called from the pool of indicia with the game indicia on the respective game face. A winning game face is identified on a game card from the plurality of distributed game cards, to constitute a winning game card at a first level of the game. A determination is made as to whether the at least one of the jackpot indicia associated with the winning game card qualifies the winning game card for a jackpot award. This includes determining whether the at least one jackpot indicium matches at least one of the game indicia on the game face of the winning game card, to constitute a second level of the game.

In another aspect, a system for playing a multiple level game of chance includes a set of game cards, each of the game cards in the set displaying a game face which includes a set of indicia selected from a pool of indicia for constituting a first level of the game. A jackpot indicium for use in playing a second level of the game is located on at least one of a game card of the set of game cards and a jackpot ticket associated with at least one game card of the set of game cards.

DETAILED DESCRIPTION

Figure 1:
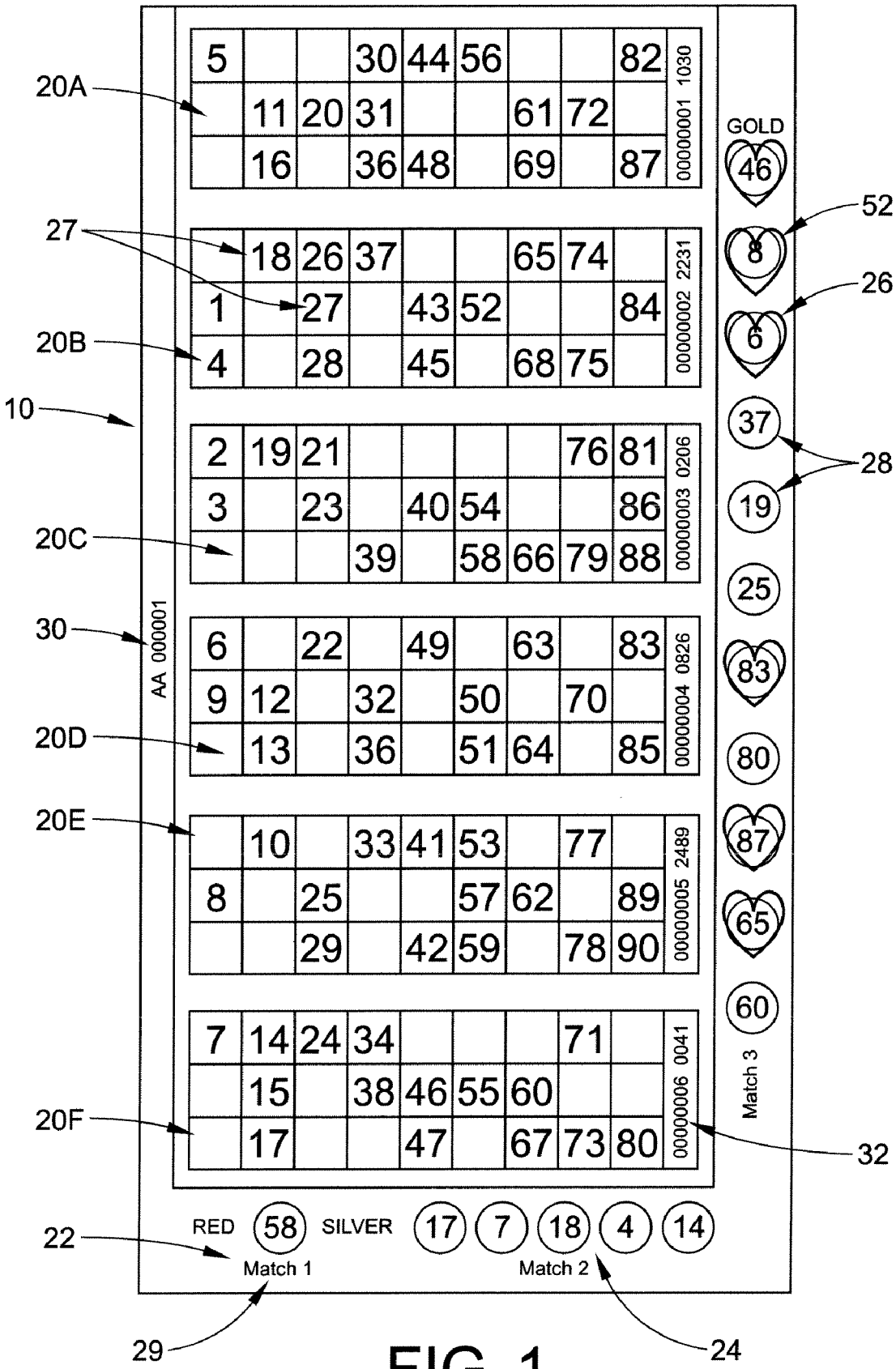
FIG. 1 is a top plan view of a ticket for use in a game of chance in accordance with one aspect of the exemplary embodiment.

While this disclosure is susceptible of embodiment in many different forms, there is shown in the drawings and will herein be described in detail, several preferred embodiments of the disclosure. However, it should be understood that the Figures are to be considered only as exemplifying the principles of the instant disclosure and are not intended to limit the disclosure to only the embodiments illustrated.

Aspects of the exemplary embodiment relate to a bingo card for playing a bingo game which provides multiple levels of play and to a jackpot ticket for use with the bingo card.

Figure 2:
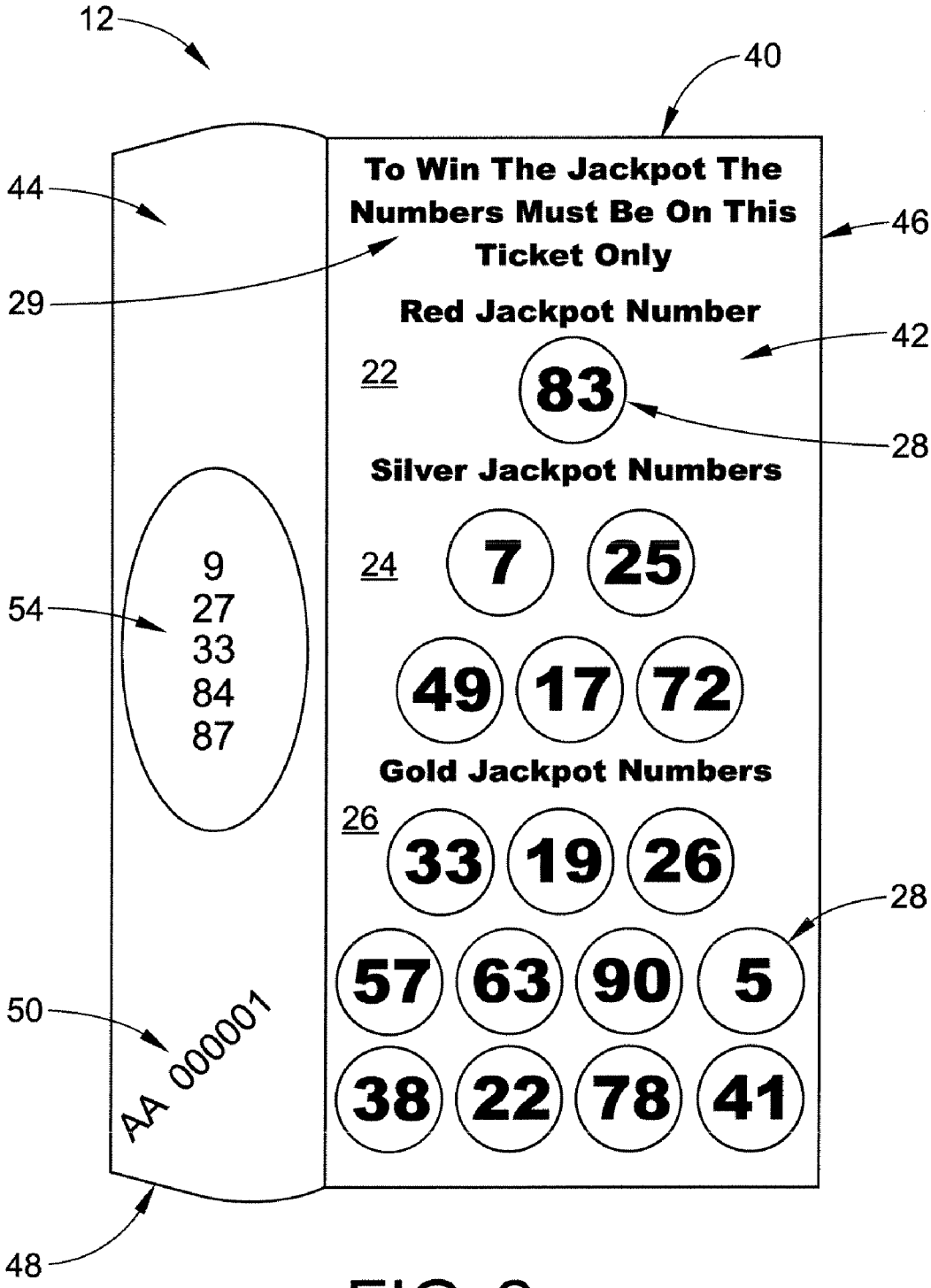
FIG. 2 is a perspective view of a jackpot ticket for use in a game of chance with the ticket of FIG. 1.

With reference to FIG. 1, an exemplary game card in the form of a bingo card or ticket 10 is illustrated. The bingo card 10 is used in combination with a jackpot ticket 12, as illustrated in FIG. 2, for playing a game of chance. In the illustrated embodiment, a bingo-type game is shown in which numbers are called randomly from a pool of numbers. Of course, other types of indicia (such as letters, geometric figures and the like) could be used in place of or in addition to numbers. Moreover, different color indicia could be employed for different values of prizes or to indicate different levels of the game.

Bingo card 10 is intended as exemplary, in that the present game system includes a substantial number of such cards. In one embodiment, for example, about 100 or 500 or more bingo cards are employed in playing the game. Each of the bingo cards 10 is purchased by a game player for a nominal sum, such as £1 or $1. The cards 10 may be packaged as a set, in a suitable wrapping (not shown).

As shown in FIG. 1, each bingo card 10 displays at least one bingo game face 20 and one or more regions 22, 24, 26 for an additional level or levels of play. The illustrated bingo card 10 includes six different game faces, labeled 20A, 20B, 20C, 20D, 20E, 20F. Each bingo face comprises a different pattern of game indicia 27, such as numbers and/or letters. As noted, other known indicia, such as stars, bells, or the like could also be used. In the illustrated embodiment, the indicia 27 will be referred to for convenience as numbers, although it is to be appreciated that other uniquely distinguishable characters or groups of characters may be employed in place of numbers.

In one embodiment, each bingo face pattern is in the form of a matrix. The illustrated matrix is a 9×3 matrix in which each vertical column is associated with numbers in the units, tens, twenties, etc respectively. Each horizontal row (referred to as a line) includes the same number of bingo numbers, five bingo numbers in the illustrated embodiment. The matrix includes spaces as well as numbers 27. In other embodiments, the matrix may be an N×M matrix where each location includes a number 27. For example, the matrix may be a 5×5 matrix in which each of the letters of the word BINGO are used to designate the columns. Under the letter "B", five unique numbers selected from 1 through 15 may be listed, and so forth.

In the illustrated embodiment of a bingo face 20, a particular type of bingo matrix is employed. For this matrix, nine columns of three number locations each are employed. Thus, thirty bingo numbers could be used in this matrix. However, to speed up play, each bingo matrix only uses fifteen numbers. These, as can be seen from FIG. 1, can be randomly distributed in the thirty number blocks. But, the numbers 1 to 9 would only appear in the first column, and so on. Certain other rules also apply. For example, there are five numbers in each of the three rows. A winning bingo face is obtained when all fifteen of the listed bingo numbers have been called.

Of course, there are a number of other known bingo matrices, in addition to the 9×3 matrix illustrated. For example, a 5×5 bingo matrix is very popular in the U.S. In the latter matrix, the numbers 1 to 75 are employed. In contrast, for bingo face 20, the numbers 1 to 90 are used. Several other bingo matrices are also popular. It should be appreciated that the jackpot game discussed herein could be used with any desired bingo matrix of N×M numbers, such as 3×3, 4×4 and so on.

The game numbers 27 in the matrix are selected from a pool of numbers, such as the numbers 1 to 70, 1 to 75, 1 to 80, 1 to 90, or the like. In the illustrated embodiment, the bingo cards are configured for use with a ninety number pool. Each of the bingo faces 20 may thus include some, but not all, of the numbers between 1 and 90, inclusive. As with a conventional bingo game, no number is represented more than once in a given bingo face 20. Each bingo face 20 in the set of bingo cards (or among those bingo faces which are designated for use in the same game, where cards have multiple bingo faces) may have a unique subset of numbers from the pool represented in the bingo face 20, i.e., no two bingo faces have an identical set of numbers. This reduces the chance of multiple winners, which is disfavored by players.

The bingo faces 20 are used in playing a game of chance, namely, a bingo game, in which a game organizer calls numbers randomly from the pool and the bingo card holders mark or daub their bingo cards according to the numbers called. The object for each of the players is to be the first to complete a predetermined configuration on one of the bingo faces and thereby have a winning bingo card. In the exemplary embodiment, the object is to have a FULL HOUSE (cover all) on one of their bingo cards 10, which occurs when every number on the bingo face 20 has been called. However, it is to be appreciated that in other embodiments, other configurations may be selected for identifying a winning bingo card, such as configurations where only one or only two lines are covered or where a configuration such as a T or X of numbers is covered. In the exemplary embodiment, a player completes a "Line" in the bingo game when all of the five bingo numbers in any one of the horizontal rows of a bingo face is covered (called). The player completes a "2 Line" when two rows in the same bingo face are covered/called. FULL HOUSE (cover all) occurs when all of the bingo numbers in all three lines of a bingo face are covered. In some embodiments, for a player to win the game, the player must also be the first to announce the FULL HOUSE, for example, by calling out "BINGO" or "FULL HOUSE."

Each of the exemplary bingo cards 10 further provides for three additional levels of play, which may be displayed in different regions 22, 24, 26 on the face of the bingo card 10. The additional levels each include one or more jackpot numbers 28 which may be distinguished from jackpot numbers of other levels by use of distinguishing indicia, here circles of different colors. Of course, a variety of other known types of indicia may also be used. A first level 22 is designated as a Red level in the exemplary embodiment, and includes one jackpot number 28. In the exemplary embodiment, for example, the jackpot number 58 is positioned in a red circle, although other methods of visually associating the jackpot number(s) 28 with their respective levels are contemplated. A second level 24 is designated as a Silver level and includes five jackpot numbers 28, all in silver circles. A third and final level 26 is designated a Gold level and includes eleven numbers 28, all in gold circles. Entry to the three jackpot levels 22, 24, 26 is conditional on the outcome of the bingo game played with the bingo faces 20 on the bingo card 10. In the illustrated embodiment, a bingo card holder is eligible for entry into, the jackpot levels only if he wins the bingo game ("cover all" in the exemplary embodiment), with one of the bingo faces on the card 10.

The jackpot numbers 28 are selected from the pool of numbers, i.e., the numbers 1-90 in the illustrated embodiment. In some embodiments, the jackpot numbers can be selected from a subset of the numbers in the pool. Additionally, at least some of the jackpot numbers 28 may appear at least once among the game numbers 27 on the bingo faces 20 on the card 10. Thus, for example, the jackpot number 58 at the red level 22 also appears in the bingo face 20C, and so forth. This provides excitement for the players because, prior to playing the bingo game, the player is able to determine that, assuming he wins the bingo game, he also has a chance of winning a jackpot award. A different combination of jackpot numbers 28 may be displayed on each card 10 in the set of bingo cards. Alternatively, two or more of the cards 10 in the set may display the same jackpot numbers.

Each of the levels 22, 24, 26 is associated with one or more instructions comprising rules 29 for play, some or all of which may be printed on the card 10. For example, the words "match 1" appear in the region of the card associated with the Red level. By "match," it is meant that the jackpot number and the bingo number are the identical number or are otherwise identified in the rules as being equivalent.

Regarding the red level 22, for example, if the player wins the game (cover all) and the jackpot number printed in the red circle matches the last number called in the bingo game, then the player wins the "red" jackpot. For the exemplary bingo card shown in FIG. 1 to win at the Red level, the bingo card holder would have to win the bingo game with bingo face 20C and the number 58 would have to be the last number which was called.

For the silver level 24, the rule 29 may specify that the player must match two of the numbers from the winning bingo face. The rule may further specify that if a player wins the game (coverall) and two of the numbers printed in the silver circles match the last numbers called on two of the Line, 2 Line, and Full House, the player wins the Silver level jackpot. For example, in the illustrated embodiment, a player who won the bingo game with the bingo face 20E would win the Silver level jackpot if either of the bingo numbers 7 or 14 was the last to be called on the first line and the number 17 was the last bingo number to be called on the third line.

In the case of the third additional level of play 26, the rule may specify that if the player wins the game (coverall) and three of the numbers printed in the gold circles match all three of the last numbers called on the Line, 2 Line, and Full House, the player wins the Gold level jackpot. In the case of the illustrated card 10, none of the bingo faces 20A-F could meet this requirement since there is no combination of three of the gold numbers which occur in the three lines of any of the faces. In general, however, before the game commences, at least some of the cards, and ideally, each card 10 in the set may potentially be a winner for at least one of the three levels.

The rules for each level are exemplary. Other rules may be provided for identifying a bingo card holder as a jackpot winner. In general, however, a minimum requirement for being identified as a winner at any given jackpot level is that at least one of the jackpot numbers for that level be found among the game numbers of the winning bingo face/bingo card. Moreover, in some embodiments, the value of award associated with the levels is greater when the chances of the award being made are lower. Thus, for example, a lower award may be made for the Red level than for the Silver level since, statistically, it is more likely that a Red level jackpot will be won.

A winner of one of the jackpot levels collects an award from the game organizer, such a monetary award or other prize. In any game of bingo, a player has a chance of winning the jackpot at one of the three levels. In general, however, a jackpot is won fairly infrequently and thus the value of the award may be much higher than of winning the bingo game itself. Accordingly, the payout for the jackpot award may be accumulated from a number of bingo games. In other embodiments, the jackpot for each level is not of a fixed value but accumulates as each bingo game is played as long as the award is not paid out. Once the award is made at a given level, the value of the award can be reset to a nominal amount.

As will be appreciated, the number of red, silver and gold numbers can be varied to change the odds of winning the individual jackpots, depending on the number of times the game is played and how often the jackpot needs to be released.

Each bingo card 10 may be printed with a unique identifier, such as a serial number 30, which may be used to identify the set of tickets to which it belongs. Similarly each bingo face 20 may also have associated therewith a unique identifier 32, which distinguishes that bingo face from other bingo faces on the same and other bingo cards in the set. Also, an identifier may distinguish a particular bingo card from bingo cards in other sets. In general each bingo face 20 in the set of bingo cards is thus associated with its own unique serial number 30. Other methods of uniquely identifying the bingo card/bingo face, such as by color, other marks, a combination of a serial number and color, or a bar code are also contemplated.

The bingo cards 10 may be formed from paper, card, or other suitable print media, with the displayed bingo face(s) 20 and serial number(s) 30, 32 printed or otherwise marked on a face thereof. In another embodiment, the bingo cards are in electronic form and are displayed to the respective player on a screen, as described in further detail below.

In a game played with the bingo cards 10 alone, if a player wanted to purchase more chances of winning the jackpot awards, he would need to purchase more bingo cards 10. As noted above, such cards are normally purchased for a nominal sum, such as £1 or $1. However, there is a limit to the number of bingo cards a player can successfully play. The exemplary game system allows a player to increase his odds of winning a jackpot by purchasing additional jackpot numbers, in the form of one or more jackpot tickets 12. Any of the jackpot tickets can also be purchased for a nominal sum, such as £1 or $1.

As shown in FIG. 2, an exemplary jackpot ticket 12 displays a set of jackpot numbers 28 for at least one of the jackpot levels 22, 24, 26. The jackpot numbers on the jackpot ticket may be in the same form as, and be used in the same way as, those on the bingo card. In particular, the jackpot numbers 28 on the jackpot tickets are numbers from the pool of numbers (1-90 in the illustrated embodiment), which appear as bingo numbers in some of the bingo faces of the bingo cards in the set. Optionally the jackpot numbers may be drawn from only a subset of the numbers in the pool. Each of a plurality of jackpot tickets displays a different combination of jackpot numbers. Thus, by purchasing more than one jackpot ticket 12, a player may increase his chances of winning a jackpot award.

In general, jackpot numbers 28 are associated with a specific one, and only one, of the bingo cards 10, as described in further detail below. In addition, the numbers 28 may not be combined among tickets/cards. Thus, to win a second or third level jackpot award, which requires two or three jackpot numbers to match bingo numbers 27 on the winning bingo face, all the matching jackpot numbers 28 must be on the same ticket 10, 12. This restriction may be indicated in the rules 29 printed on each jackpot ticket.

In the illustrated embodiment, the jackpot ticket 12 displays the same quantity of jackpot numbers at each level 22, 24, and 26 as are shown on the bingo cards 10. Players may be given the opportunity to purchase one or more of the jackpot tickets 12. Purchasing a jackpot ticket thus provides the player with additional chances of winning the jackpots by providing different jackpot numbers. Thus, a player with a winning bingo face 20 on his card 10 may have several sets of jackpot numbers, due to his purchase of one or more jackpot tickets 12.

In some embodiments, the jackpot tickets 12 may be configured to conceal the jackpot numbers 28 that are printed thereon, prior to sale. For example, the jackpot tickets may each be configured as a scratch card, pop-open ticket, sealed ticket, or the like in which the numbers are initially covered by a cover member. In FIG. 2, the illustrated jackpot ticket 12 is in the form of a seal card which includes upper and lower layers or plies 40, 42 of material, laminated together at the edges of their inner surfaces, and formed from paper, card, or the like. This type of ticket is typically referred to as a "break-open" playing card, in that the cover member comprises one (or more) flap-like portions 44 of one ply 40 which cover one or more of the jackpot number printed on the other ply 42. The flap 44, or upper ply 40, can be selectively opened (e.g., peeled away from the ticket 12) in order to reveal a window(s) 46 displaying the set of jackpot numbers 28 on the lower ply 42. The flap 44 has perforated edges 48, allowing it to be readily separated from the surrounding upper ply material.

In other embodiments, the jackpot tickets 12 may be formed without a cover member, for example, as simple tickets which are not sealed. In one embodiment, the tickets 12 may be printed by a computer device which is programmed to randomly generate a set of jackpot numbers 28 at the point of sale.

Each additional set of jackpot numbers 28 is associated with a bingo card 10 that the player has purchased. This avoids the instance of sharing of jackpot numbers. An identifier 50, such as a serial number, is optionally printed, or stamped on, handwritten, or otherwise affixed to one of the plies 40, 42 for identifying the jackpot ticket as being associated with a particular bingo card 10 (and generally, only one bingo card) and/or particular bingo game in which the tickets 10, 12 are to be used. For example, the jackpot ticket 12 may be electronically franked with the alphanumeric serial number 30 or 32 already printed on the player's bingo card. This avoids the instance of a player from a previous game trying to collect an award in a subsequent game using the same jackpot ticket 12. A set of jackpot tickets 12 may be packaged together, for example, along with the set of bingo cards 10.

The jackpot tickets 12 distributed for use in a particular game are configured such that different ones of the jackpot tickets each have a different combination of jackpot numbers 28. Additionally, the distributed tickets 12 are configured such that the combination of jackpot numbers on a given ticket 12 is also likely or guaranteed to differ from the combination of jackpot numbers on the player's card 10. Accordingly, a player generally increases his chances of winning one of the jackpot awards by purchasing one or multiple jackpot tickets. Additionally, a player purchasing one or multiple jackpot tickets may also increase his chances of winning multiple jackpot awards in the same game.

A method for playing a game of chance with the exemplary bingo cards 10 and jackpot tickets 12 may proceed as follows. One object for each of the players is to be the first to complete a predetermined configuration on the bingo face 20 and thereby have a winning bingo card. Thereafter, the bingo card holder may be eligible for a jackpot award. In the exemplary embodiment, the object is to have a FULL HOUSE (cover all) on one of the bingo faces 20, which occurs when every number on the bingo face 20 has been called. However, it is to be appreciated that in other embodiments, other configurations may be selected for identifying a winning bingo card, such as configurations where only one or only two lines are covered or where a configuration such as a "picture frame" of numbers (i.e., only the numbers on the outer periphery of the bingo face) is covered.

Figure 4:
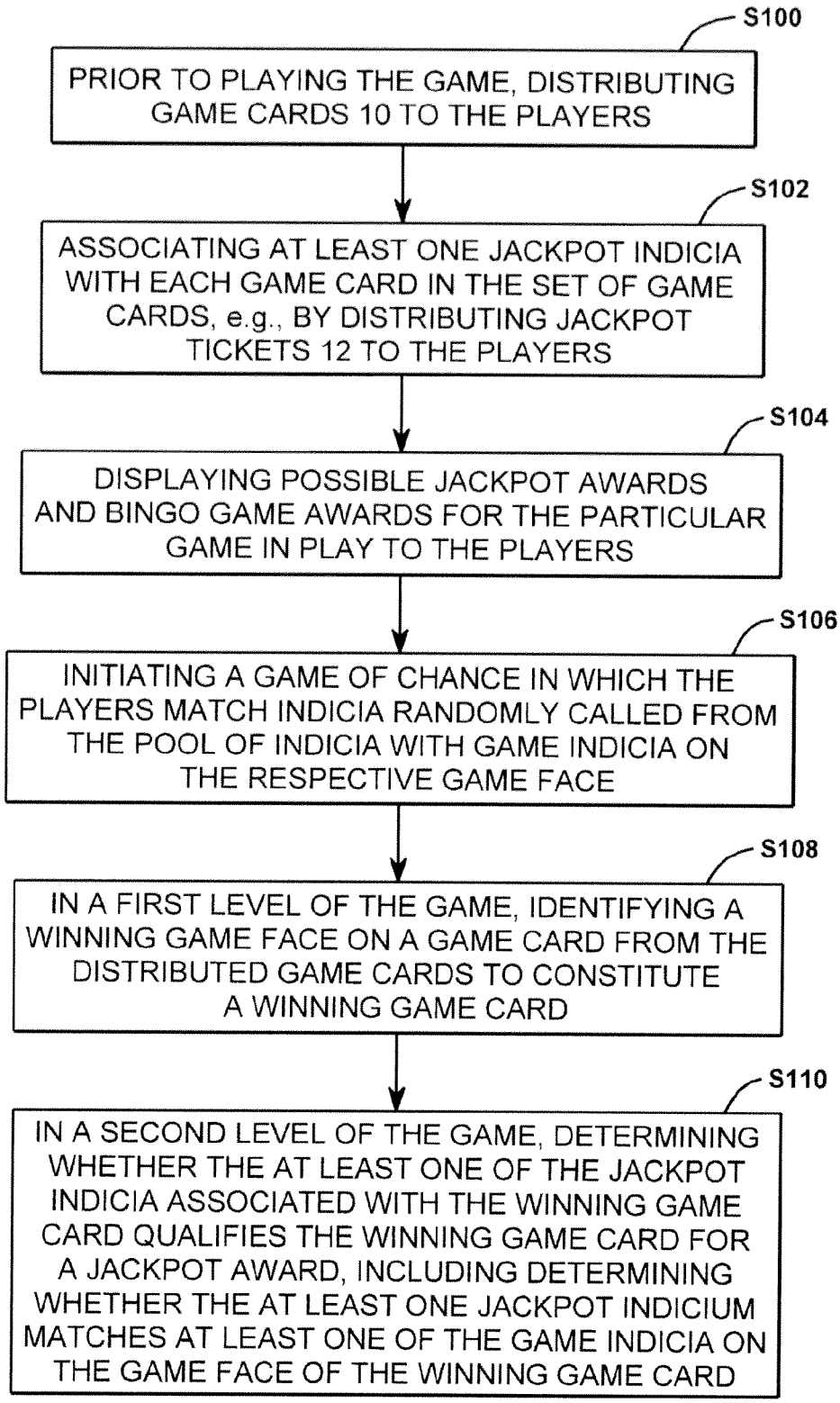
FIG. 4 illustrates a method for playing a game of chance in accordance with an exemplary embodiment of the present disclosure.

Prior to playing the game, and with reference now also to FIG. 4, bingo cards 10 and jackpot tickets 12 are distributed to the players (S100). For example, players may each purchase one or more bingo cards 10 for a nominal sum. Additionally, players may choose to purchase one or more jackpot tickets 12 (S102). At the time of purchase, the jackpot ticket(s) 12 is marked with a serial number or other code which identifies the bingo card 10 with which it is to be associated. The possible jackpot awards and bingo game awards for the particular game in play may be displayed to the players (S104).

Once the players have had an opportunity to purchase bingo cards and jackpot tickets, and break open or otherwise reveal the numbers on any associated jackpot tickets, the operator initiates the calling of numbers (S106). For example, the numbers are called from the pool, generally in a random or pseudo-random fashion, both of which will be considered random for purposes of the description herein. In some games, each of the numbers in the pool is represented by a ball in a large rotating bin. Each ball has a unique one of the bingo numbers. The bin is rotated and one of the balls is randomly selected. The number of the selected ball is announced to the players, generally either by the game operator and/or by displaying the number on a video screen or manually operated flashboard positioned within view of the players.

In other embodiments, the numbers may be generated by a computing device which runs an automated random number generating program. Each player then checks his bingo cards 12 to see if the announced number appears on any of the bingo faces 20 that are in play. If the number appears on a bingo face in play, the player marks (or daubs) the called number on the bingo face using an item such as a bingo marker, pen, or other marking device. The calling of numbers is repeated several times, each time allowing the players time to mark their bingo cards. When a player achieves a designated winning combination or pattern such as "full house" (all of the numbers in the bingo face are marked), the player wins the game (S108).

Depending on the rules of the game proprietor, the player may be required to call out "Bingo," or otherwise announce that he has completed the predetermined pattern. Otherwise, the game may continue with one or more further calls being made until a player announces he has a FULL HOUSE. Of course, the game may end with the first winning bingo face and the game proprietor announcing that fact to the players, who then search their cards for the winning bingo face. The holder of a winning bingo card 10 would then collect his prize from the game organizer. The prize may be a monetary award, tickets for another game, or other prize.

Additionally, the winning player would check the set or sets of jackpot numbers 28 associated with the winning bingo card, either displayed on the same bingo card 10 or on a jackpot ticket 12 which has been linked to the bingo card 10. If the player has a winning jackpot number or combination of jackpot numbers (i.e., which match bingo numbers on the winning ticket and obey(s) the rules of one or more of the jackpot levels), the player may also announce this to the game organizer. The game organizer verifies that the player has correctly identified the winning jackpot number or combination of jackpot numbers on a ticket or tickets 10, 12 in play and distributes the associated award (S110).

As will be appreciated variations on the above-mentioned method may be adopted to meet the needs of the game organizer. For example, in some events, it may be desirable for a jackpot level award to be made early on in the event. For example, a game organizer may wish to award a gold level award at an early stage to encourage participation in later games. In such a case, the set of jackpot numbers 28 printed on the tickets 10, 12 for the gold level 26 may exclude certain numbers that are in the pool, such as the numbers 1-10 or all numbers ending in a 9 (i.e., 9, 19, 29, etc.) from a pool containing the numbers 1-90. These excluded jackpot numbers may then be released by the game organizer in part or in whole to be added to the players own gold jackpot numbers, thus dramatically increasing the odds of the jackpot being released. In this case, the game organizer may chose not to sell any of the jackpot tickets 12 for that round of play, since the jackpot tickets could result in additional winners for the jackpot prize.

As will be appreciated, the number of jackpot numbers at any level and the rules can be varied to alter the outcome of the game. For example, in one embodiment, the gold jackpot may be awarded, on average, less frequently, by reducing the number of gold jackpot numbers printed on the bingo card. It should be appreciated that if a jackpot is not won during a particular game, the proceeds are added to the jackpot so that the jackpot grows for the next game. In other words, a progressive jackpot is contemplated.

In one embodiment, an additional or alternative jackpot level may be provided in which players are provided the chance to win a further award (or an award of higher value). Such awards may be organized on a regional level with several game organizers/clubs participating in providing the award. For example, an additional game symbol 52 may be provided on some bingo cards and/or associated with one or more of the jackpot numbers 28 (FIG. 1). The game symbol 52 may be a heart, alphanumeric character, or the like. For example, a certain number of the gold jackpot numbers (e.g., six) may be printed on or adjacent to a symbol such as a heart. The rules of the game may specify that if the player matches two of their "heart" numbers with two of the last numbers called, the player wins the regional jackpot.

In another embodiment, jackpot numbers 54 may be distributed to some or all players which remain valid for a certain period of time, such as an evening of play or a week of play. This enables a third tier of jackpots (House jackpots). For example, players may be provided with the opportunity to purchase a separate set of jackpot numbers (House numbers) 54 that may last for a predetermined period and could be linked to a particular day of the week. In one embodiment, a player is permitted to purchase a set of numbers (such as five numbers) that are valid for each Monday in the following four weeks or month. Different rules may apply for these numbers than for other jackpot numbers. For example, the rules may require that a player winning the bingo game matches two of the house numbers with the last two numbers called to win the House jackpot. This additional set of House numbers 54 could be stamped on the bingo card or jackpot ticket, for example, by stamping with a dabber having a printed label with a set of numbers, as illustrated in FIG. 2. In this way, a different set of House numbers could be distributed for each day of the week, e.g., by employing a different color dabber.

Figure 3:
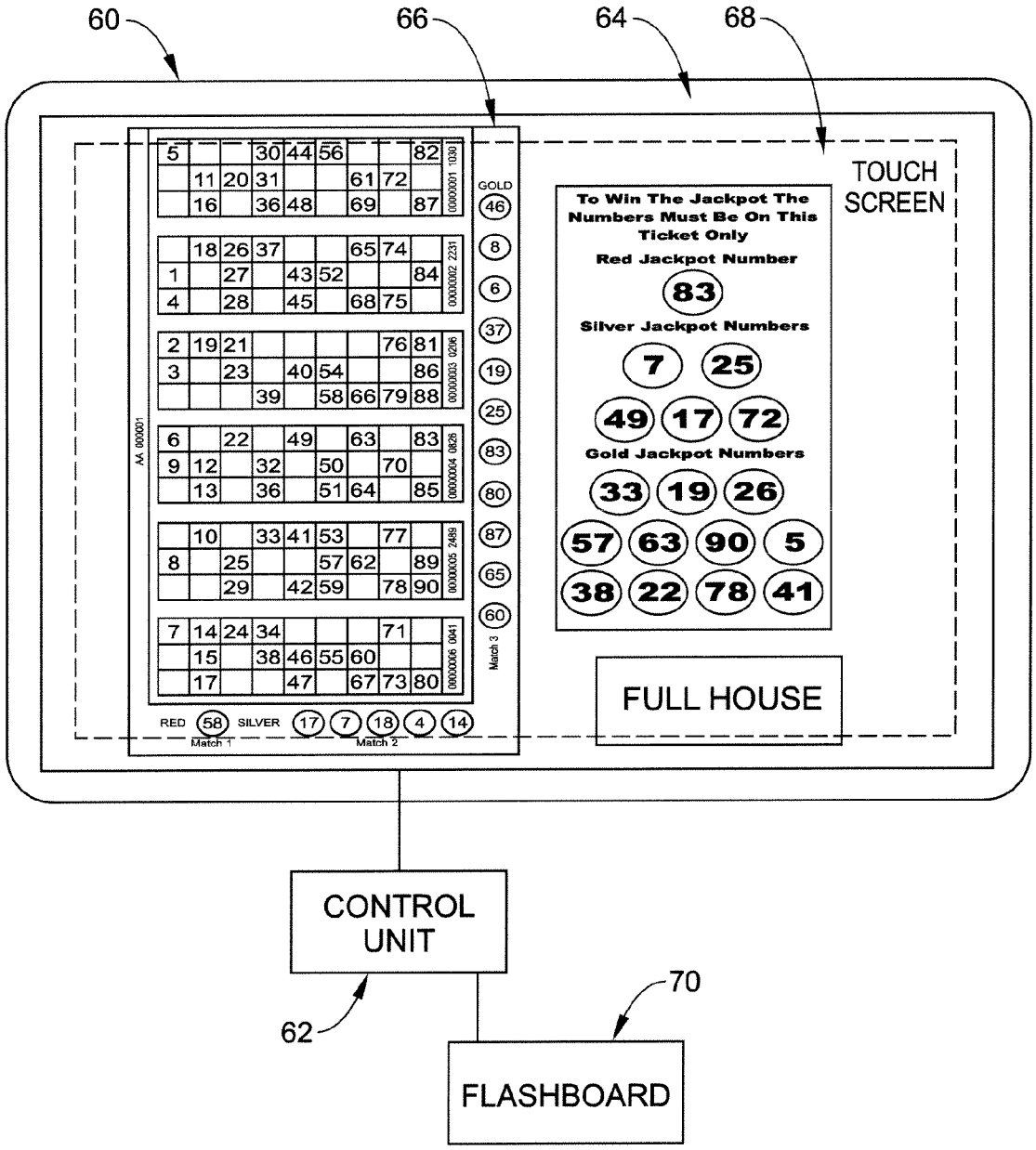
FIG. 3 illustrates an exemplary system which includes one or more electronic bingo units in accordance with another aspect of the exemplary embodiment.

While in the exemplary embodiment, the bingo faces and jackpot numbers are distributed in tangible form, i.e., as printed tickets 10, 12, in other embodiments, the bingo cards, and optionally also the jackpot numbers, may be distributed electronically. For example, electronic bingo units in a computer controlled system could be used as illustrated in FIG. 3. In this embodiment, one or a plurality of electronic bingo units 60 are communicatively linked to a control unit 62, which may be embodied in a computing device, that is operated by the game organizer. The control unit 62 includes a processor which runs software, stored in associated memory, for generating representations of bingo cards/faces and jackpot tickets/jackpot numbers in response to the receipt of a payment from a player, e.g., via a coin or token slot or credit card slot (not shown) on the bingo unit. The control unit 62 also includes a random number generator which calls numbers from the pool of numbers. The bingo units 60 may each include a graphical user interface (GUI) 64, including a visual display 66, such as an LCD screen, and a user input device 68, such as a keyboard, keypad, touch screen, cursor control device (e.g., a mouse or joystick), or combination thereof. A user operates the GUI 64 to make selections, electronically daub the bingo numbers on the bingo face 20, and electronically announce to the control unit 62 when the player has a FULL HOUSE, or other winning configuration.

The control unit 62 may be embodied in one or more general purpose computers, special purpose computer(s), a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA, or PAL, or the like. For example, the control unit and GUI may be housed in a common housing of the bingo unit 60 or may be embodied in a desktop computer, a laptop computer, a personal digital assistant (PDA), cell phone, MP-3 player or other computerized platform.

Instructions for the control unit 62 may be stored on a computer program product. In particular, the computer program product stores at least a part of a computer program which allows bingo faces/bingo cards and jackpot numbers to be distributed to the players electronically, causes the generation of calls with a random number generator, causes the called numbers to be displayed on the bingo units and/or on a flashboard; and allows the verification of the winning bingo card(s) and any jackpot awards. As will be appreciated, modifications may be made to the game whereby not all these operations may be programmed on the computer program product.

The computer program product may encode instructions, which may be executed on a computer. The computer program product may be a tangible computer-readable recording medium on which a control program is recorded, such as a disk, hard drive, or may be a transmittable carrier wave in which the control program is embodied as a data signal. Common forms of computer-readable media include, for example, floppy disks, flexible disks, hard disks, magnetic tape, or any other magnetic storage medium, CD-ROM, DVD, or any other optical medium, a RAM, a PROM, an EPROM, a FLASH-EPROM, or other memory chip or cartridge, transmission media, such as acoustic or light waves, such as those generated during radio wave and infrared data communications, and the like, or any other medium from which a computer can read and use.

The instant disclosure has been described with reference to the preferred embodiments. Obviously, modifications and alterations will occur to others upon reading and understanding the preceding detailed description. It is intended that the exemplary embodiment be construed as including all such modifications and alterations, insofar as they come within the scope of the appended claims or the equivalents thereof.

The invention claimed is:

1. An apparatus for playing a game of chance comprising:

a set of game cards, each of the game cards in the set displaying at least one game face which includes a set of indicia selected from a pool of indicia, each of the at least one game face comprising a unique subset of the indicia in the pool, each game card further displaying at least one jackpot indicium selected from the pool of indicia; and a plurality of jackpot tickets for use in combination with the set of game cards, the jackpot tickets each displaying at least one jackpot indicium selected from the pool of indicia, whereby a player who wins a game of chance played with at least one of the at least one game face is able to identify from the game face and any jackpot tickets which have been associated with the game card whether he is also a winner of a jackpot award.

2. The apparatus of claim 1, wherein the indicia comprise numbers arranged in a bingo matrix.

3. The apparatus of claim 1, wherein a plurality of levels of jackpot indicia are displayed on each of the jackpot tickets and each of the game cards.

4. The apparatus of claim 1, wherein at least one of the jackpot tickets and the game cards displays instructions for determining whether the at least one jackpot indicia qualifies the player for the jackpot award.

5. The apparatus of claim 1, wherein a plurality of jackpot indicia is employed and the jackpot indicia are displayed in a plurality of regions of each of the jackpot tickets, each of the regions being associated with a jackpot award.

6. The apparatus of claim 1, wherein the pool of indicia comprises at least seventy indicia.

7. The apparatus of claim 1, further comprising a unique identifier for each game card in the set.

8. The apparatus of claim 1, wherein the game cards comprise print media on which the game face is printed.

9. An apparatus for playing a game of chance comprising:

a set of game cards, each of the game cards in the set displaying a game face which includes a set of indicia selected from a pool of indicia; and a plurality of jackpot tickets for use in combination with the set of game cards, the jackpot tickets each displaying at least one jackpot indicium selected from the pool of indicia, whereby a player who wins a game of chance played with the game face is able to identify whether he is also a winner of a jackpot award, the jackpot tickets each comprising a removable cover member which conceals the jackpot indicia.

10. The apparatus of claim 1, wherein the jackpot tickets each include an identifier which associates the jackpot ticket with a corresponding game card in the set of game cards.

11. An apparatus for playing a multiple level game of chance, comprising:

a package comprising:

a set of game cards, each of the game cards in the set displaying a game face which includes a unique subset of indicia selected from a pool of indicia for constituting a first level of the game; and a set of jackpot tickets;

jackpot indicia for use in playing a second level of the game, the jackpot indicia being located on:

a game card of the set of game cards, and a jackpot ticket which has been associated with the game card of the set of game cards.

12. The apparatus of claim 11, wherein a plurality of jackpot indicia are provided on each game card and each jackpot ticket.

13. The apparatus of claim 12, wherein the plurality of jackpot indicia comprise a plurality of levels of the game.

14. The apparatus of claim 11, further comprising a unique identifier for associating a game card of the set of game cards with the jackpot ticket.

* * * * *